United States Patent [19]

Koehler

[11] 4,396,652

[45] Aug. 2, 1983

[54] ARTIFICIAL SHRUBS

[75] Inventor: Rudolph A. Koehler, Willowdale, Canada

[73] Assignee: Noma Canada Inc., Scarborough, Canada

[21] Appl. No.: 379,440

[22] Filed: May 18, 1982

[51] Int. Cl.[3] ..... A41G 1/00

[52] U.S. Cl. ..... 428/17; 428/18; 211/105; D11/118

[58] Field of Search ..... 428/7, 8, 18, 19, 20; 211/105; D11/118; 362/123

[56] References Cited

U.S. PATENT DOCUMENTS 3,811,991 5/1974 Dieffenbach ..... 161/24
4,101,697 7/1978 Dieffenbach et al. ..... 428/9

FOREIGN PATENT DOCUMENTS 903473 6/1972 Canada ..... 41/6
2041747 9/1980 United Kingdom .

*Primary Examiner*—George F. Lesmes
*Assistant Examiner*—P. R. Schwartz
*Attorney, Agent, or Firm*—Kenneth M. Garrett; Kevin P. Murphy

[57] ABSTRACT

An artificial shrub comprises a central trunk and a plurality of branches connected thereto by a loop at the end of each branch which is receivable directly on the trunk. Shrubs of this construction are easily user assembled and adjusted for aesthetic effect, particularly where the branches are of appreciable axial extent and downwardly, outswept from the loops. A branch rest in the form of a serrated hoop may be provided to give lateral and radial support for the branch ends.

13 Claims, 3 Drawing Figures

FIG. 1.
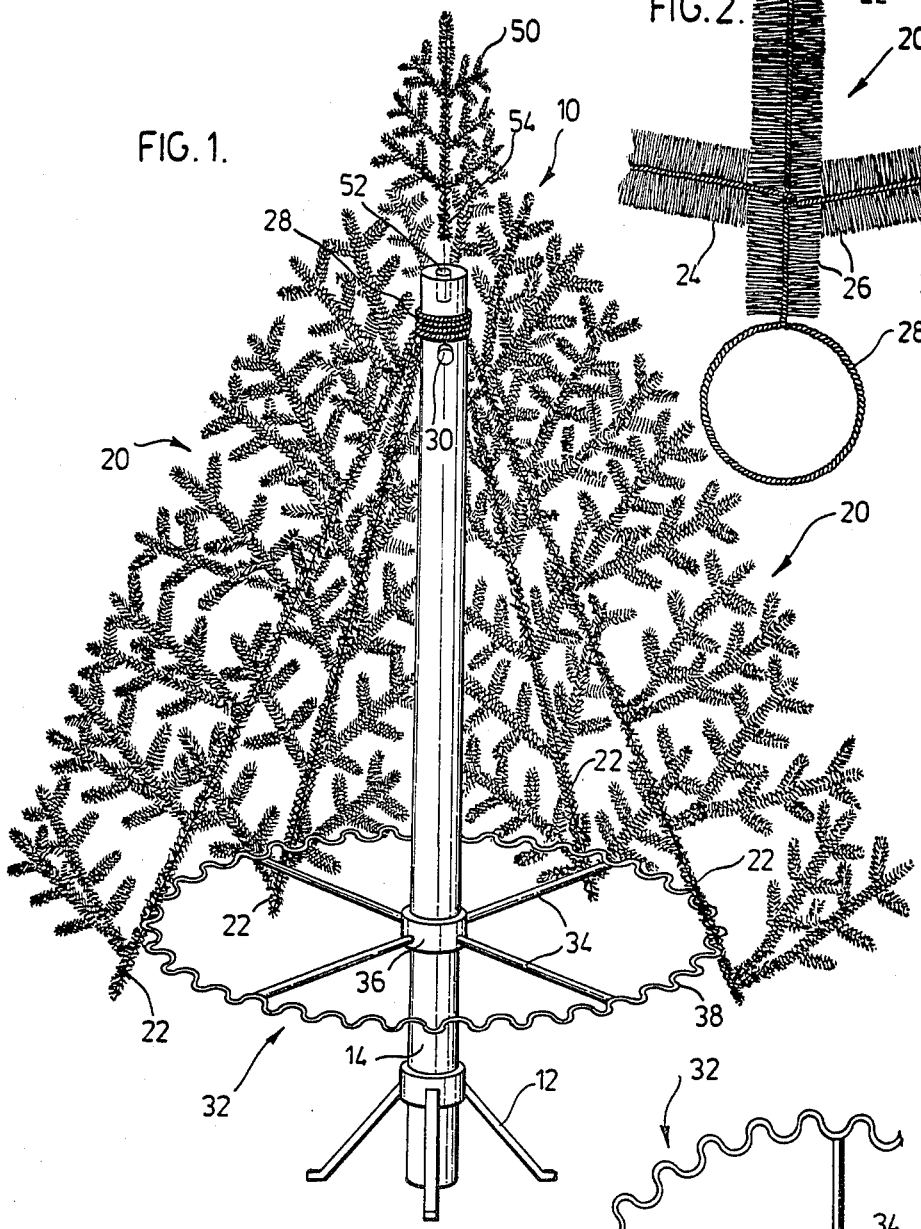
FIG. 2.
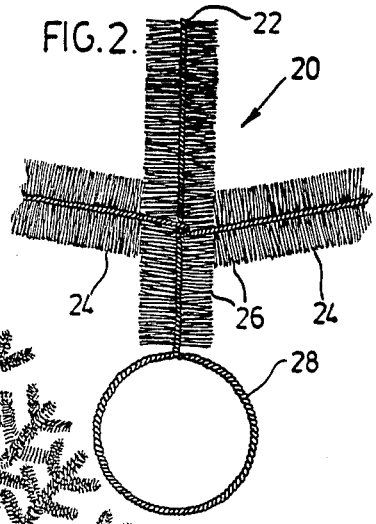
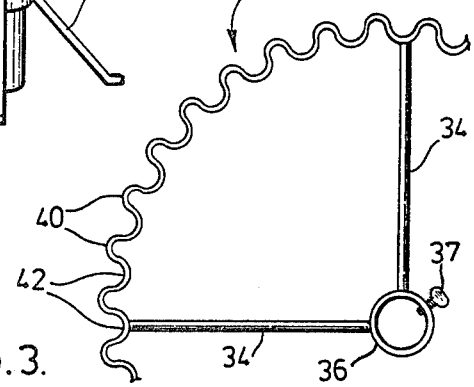
FIG. 3.

ARTIFICIAL SHRUBS

FIELD OF INVENTION

This invention relates to artificial shrubs. It particularly relates to improvements permitting rapid and variable assembly of the shrubs from a kit of parts.

BACKGROUND OF INVENTION

Artificial shrubs as currently found in commerce for user assembly comprise a stand and a main support simulating a trunk erected therefrom. The tree is furnished with branches supported from the trunk, each branch comprising a stem with one or more side branches carried thereon. The branches may generally radiate upwardly and outwardly from the trunk, with several branches connecting to the trunk over a relatively short length to form a tier, adjacent tiers being axially spaced apart. In another form of construction the branches radiate downwardly and outwardly from the trunk to generally enclose a hollow truncated conical space which typically extends axially over several tiers of the first form of construction. The second form of construction may be referred to as a hollow construction, and the shrub formed thereby a hollow shrub. In both forms of the shrub, sockets are predisposed about the trunk for receiving the branch stems. Such arrangement is not conducive to any variation in the furnishing of the tree, that is to say it does not readily permit any change in the quantity or disposition of the branches that may be supported from the trunk without creating an unbalanced appearance. It is, moreover often difficult to locate the sockets, particularly when the tree is densely furnished, and this sometimes results in the branch stem being incompletely or improperly engaged, whereby the socket wall may break out or the branch collapse under the weight of tree decorations, for example. A still further disadvantage of currently known constructions is their cost. Artificial shrubs, particularly those which are mass produced primarily for seasonal use as Christmas trees, are relatively low priced items, and there is a considerable economic incentive to provide a reduced manufacturing cost.

It is then an object of my invention to provide an improved construction for artificial shrubs whereby the shrubs are more readily assembled.

It is a further object of my invention to provide artificial shrubs wherein the furnishing can be readily changed either as a manufacturing step or by a user.

It is yet another object of my invention to provide artificial shrubs of greater economy.

In accordance with one aspect of my invention, an artificial shrub comprises a trunk, and branch stems to be supported therefrom, each branch stem terminating in a loop which is engageable on the trunk. Preferably a loop will be proportioned so that it slides snugly down the trunk, to be rotatable freely thereabout.

Expediently the branch stems are formed from twisted wire as is well known in the art, and a loop is fashioned unitarily with a stem. Since the trunk is normally of relatively large diameter, usually about 2 to 2.5 cms for shrubs having a height in the range of about 1.5–2 m, it will be appreciated that the end of the trunk is normally easily locatable for the loops to be engaged therewith and there is no likelihood of a loop being improperly engaged. Where, as in the preferred embodiment, the loops are rotatable about the trunk, their relative positions may be readily changed so as to permit for example the incorporation of more or less branches into a particular shrub whilst retaining the correct spacing therebetween and a proper visual balance, or an asymmetric arrangement should this be desired.

Means is provided for limiting the axial travel of the loops on the trunk. Such means may comprise a shoulder supported from the trunk at a predetermined or a user selectable position. Since a loop engages a trunk continuously thereabout, it is not necessary that the shoulder be continuous about the trunk, and a shoulder of limited peripheral extent is generally found to be suitable. Of course, I do not preclude more complex means, although in general this will be inimical with the provision of a low priced structure. Normally a one shoulder will provide a travel limit for a plurality of loops in stacked relation.

Having determined the desired lateral spacing between contiguous branch stems, it may be desirable to fix their relative positions, and it is envisaged tht a simple clamp may be provided to clamp the loops between it and a travel limit shoulder. In an alternative arrangement particularly for use with shrubs of hollow construction wherein it is known to provide a rest for distal portions of the branches, the rest may be formed with a serrated surface thereby providing outwardly facing notches within which the branch stems are receivable so as to give both radial and lateral support for the branches.

BRIEF DESCRIPTION OF DRAWINGS

My invention will be further described in relation of a preferred embodiment thereof, taken in conjunction with the accompanying drawings wherein:

FIG. 1 shows a hollow, artificial shrub partly assembled, constructed in accordance with my invention;

FIG. 2 shows in enlarged scale the end portion of a branch of FIG. 1 and FIG. 3 shows in plan view a quadrant of a hoop rest forming part of the construction of FIG. 1.

DESCRIPTION OF PREFERRED EMBODIMENT

Referring to the FIGS. 1–3 in detail, an artificial shrub of hollow construction is identified generally herein by the numeral 10. Shrub 10 comprises a stand 12 and a trunk 14 erected thereon. Trunk 14 may be sectional or one piece as desired. A plurality of branches 20 are supported from trunk 14, branches 20 together forming a hollow, truncated conical envelope. Branches 20 comprise a stem 22 and a plurality of side branches 24 which project generally forwardly therefrom at spaced intervals therealong so as to overlap both vertically and laterally. Typically stem 22 may have a length in the range of 1 to 2 m. Branch 20 is conveniently formed from wire twisted to entrap filament 26 therein as is well known in the art. The proximal end of stem 22 is fashioned into a closed loop 28 having an internal diameter so as to permit the loop to be engaged on trunk 14 and slide therealong. A stop element 30 forms a shoulder on trunk 14 to engage loop 28 and limit the downward travel thereof. Stop element 30 may conveniently be formed by a transverse dowel held in trunk 14, but other more or less elaborate means may be used. The loop 28 of the next engaged branch will be supported on trunk 14 by the underlaying loop and so on. Preferably trunk 14 will be of uniform, circular cross section, at least in that part thereof immediately superior to stop element 30, thereby forming an axle about which branches 20 may be rotated. In this manner the lateral spacing between adjacent branches may be adjusted as desired for preferred aesthetic or functional effect.

The looped ends 28 of stems 22 are bent so as to lie in a horizontal plane whereby the stem subtends the desired angle to trunk 14, usually some 30° or thereabout. Due to the considerable moment arm of stem 22, some sagging and springing of branches 20 is experienced, and it is preferred to provide a rest for distal portions of the stem. A suitable rest is identified generally by the numeral 32 and comprises a plurality of spokes 34 radiating from a hub 36 secured to trunk 14 by a screw 37. A hoop 38 continuously formed about its periphery with serrations 40 is concentrically mounted on spokes 34 to contact stems 22. Serrations 40 form outwardly facing notches 42 within which to receive stems 22, hoop 38 thus providing both radial and lateral support for branches 20. Owing to the relatively large number of serrations 40 located about hoop 38, it will be appreciated that for all intents and purposes the lateral spacing between branches 20 may be varied as desired whilst ensuring proper lateral support for the branches.

Shrub 10 is typically capped by providing a preformed top 50 having a tier construction, trunk 14 having an opening 52 in the upper end thereof for receiving the proximal end 54 of top 50 therein so as to blend smoothly and continuously with the lower portion of the construction.

I claim:

1. An artificial shrub for user assembly comprising:

a stand;

a trunk erectable from said stand;

a plurality of branches each having a stem supported from said trunk;

characterized whereby each said stem is provided at the proximal end thereof with a loop formed in a horizontal plane receivable on said trunk so as to support said stems directly therefrom, and means for limiting the axial travel of said loops on said trunk.

2. An artificial shrub as defined in claim 1, wherein said loops are rotatable about the major axis of said trunk.

3. An artificial shrub as defined in claim 1, wherein said loops are unitarily formed with said stems of said branches.

4. An artificial shrub as defined in claim 3, wherein said stems are formed of twisted wire.

5. An artificial shrub as defined in claim 1, 2 or 3, wherein said means for limiting the axial travel of said loops on said trunk comprises at least one shoulder on said trunk.

6. An artificial shrub as defined in claim 1, 2 or 3, wherein said means for limiting the axial travel of said loops on said trunk comprises at least one shoulder of limited peripheral extent on said trunk.

7. An artificial shrub as defined in claim 2, 3 or 4, wherein said branches are adapted to be downwardly supported from said loops to form a hollow shrub.

8. An artificial shrub as defined in claim 2, 3 or 4 further comprising a rest mounted from said trunk to support distal portions of said branches.

9. An artificial shrub as defined in claim 2, 3 or 4, further comprising a rest mounted from said trunk to distal portions of said branches, said rest comprising a hoop member continuously formed about its periphery with serrations within which said distal portions are receiveable so as to provide lateral location and support therefor.

10. An artificial shrub as defined in claim 2, 3 or 4, further comprising a preformed top section supported from the distal end of said trunk.

11. An artificial shrub of hollow construction comprising:

a trunk and stand therefor;

a plurality of branches each comprising an axially elongated stem portion and side branches supported therefrom;

said stem portion terminating at one end in a closed loop slidingly receivable on said trunk to be rotatable thereabout;

said stem portion being angularly deformed adjacent said loop whereby said stem portion extends downwardly and outwardly from said trunk;

stop means for limiting the axial travel of said loops on said trunk, and rest means axially spaced from said stop means for supporting distal ends of said stems from said trunk.

12. An artificial shrub as defined in claim 11 wherein said rest means is provided with a plurality of laterally spaced outwardly opening notches to provide lateral support to said distal ends.

13. An artificial shrub as defined in claim 11 wherein said stop means comprises a transverse dowel.

* * * * *